United States Patent [19]

van Eyken et al.

[11] Patent Number: 4,534,527

[45] Date of Patent: Aug. 13, 1985

[54] ALL WEATHER SWITCH FOR RAILROADS

[75] Inventors: Lawrence A. J. van Eyken, Kingston; Semion Perlin, Willowdale, both of Canada

[73] Assignee: Canadian Patents & Development Limited, Ottawa, Canada

[21] Appl. No.: 575,407

[22] Filed: Jan. 30, 1984

[51] Int. Cl.[3] ..... E01B 7/02

[52] U.S. Cl. ..... 246/445; 246/448

[58] Field of Search ..... 246/445, 446, 447, 448, 246/415 R, 435 R, 428; 104/130

[56] References Cited

U.S. PATENT DOCUMENTS 3,317,725 5/1967 Jensen ..... 246/445

FOREIGN PATENT DOCUMENTS 23101 of 1904 United Kingdom ..... 246/446

*Primary Examiner*—Edward K. Look

*Attorney, Agent, or Firm*—Richard J. Hicks

[57] ABSTRACT

An improved railroad stub switch is described in which the axial rail tension or compression forces due to temperature fluctuations are transmitted through the switch by means of radius arms connected to both the switch and fixed rails, thereby eliminating the need for expensive expansion joints at the switch. In a preferred embodiment, interlocking point shoes are also employed so as to hold the butt ends in vertical and horizontal register and transmit a signal to the trailing side rail of the impending approach of a load from the approach side rail, thereby reducing batter on the trailing side rail.

7 Claims, 6 Drawing Figures

ALL WEATHER SWITCH FOR RAILROADS

FIELD OF INVENTION

This invention relates to railroad stub or butt switches of the type in which the ends of the moving rails are substantially squarely truncated, as opposed to split switch construction, in which the rail ends are sharply pointed or tapered. More particularly this invention relates to a novel all-weather stub switch which avoids the problems of snow, sand or dirt build-up heretofore encountered with split switches.

BACKGROUND OF INVENTION

In a stub switch, known per se to the art, lengths of switch rail are movably mounted between the approach or lead side of the switch and the run out or trailing side of the switch, such that the switch rails form a continuation of the fixed rails and connect the main fixed rails on the approach side to either the main fixed rails on the trailing side or the turnout fixed rails on the trailing side, as selected.

There are a number of ways in which movement of the switch rails between the trailing main rail and trailing turnout rail positions may be effected, and attention is drawn to Canadian Pat. Nos. 87,972, 125,022 and 303,138 which illustrate the use of gauge rods and a plurality of interconnected cam actuators arranged in series along the length of the switch rail, each having a progressively increasing throw so that a relatively long length of switch rail fixed at the approach end thereof may be bent in a controlled curve so that the trailing end thereof can be moved from the main rail position to the turnout rail position.

In the early 1900's, as railway speeds and axis loads increased, stub switches generally fell into disregard and disuse and were largely replaced with split switches which could more readily accept the heavier stresses and strains imparted by the heavier cars. Further, it was very difficult to maintain the old stub switches in alignment with the result that wheels with sharp flanges tended to climb the rails and furthermore such wheels imparted heavy battering loads on the rail ends. As the rails expanded during hot weather the clearance between the rail ends decreased and could even cause a binding condition. In cold weather the rails contracted and the clearance increased substantially, thus compounding the batter problem. In view of these problems the stub switch was superceded by the split switch, but long experience has shown that it too suffers from serious disadvantages. Heavy snow tends to clog split switches and this has to be cleaned out before they can be operated. In desert conditions, blowing sand similarly clogs split switches and has to be removed before operation. Failure to do so can result in twisting or buckling of the switch or its actuating mechanism or in a failure of the switch to open or close properly. The cost of split switches is very high, moreover, as many of the parts require special manufacturing equipment not readily found in machine shops and, furthermore, the life of a split switch is relatively short as the amount of material available in the tapered rails is quite small and is subject to considerable wear and distortion. Thus, it will be appreciated that stub switches have the advantage that they have a longer effective life than split switches, are generally cheaper to manufacture and are not subject to clogging with snow, ice or sand. There is, therefore, a need for an improved stub switch which will avoid the disadvantages of the old stub switches but also avoid the disadvantages of the presently used split switches.

BRIEF STATEMENT OF INVENTION

It is, therefore an object of the present invention to provide an improved stub switch in which the axial rail tension or compression forces due to temperature fluctuations are transmitted through the switch by means of radius link arms connected to both the switch and fixed rails, thereby eliminating the need for expensive expansion joints at the switch.

It is another object of the present invention to provide an improved stub switch in which the butt ends of both sets of rails terminate with interlocking point shoes, thereby allowing the butt ends to be held in vertical and lateral register in either position of the switch so as to reduce batter of the rail ends and to transmit a signal to the trailing side rail of the impending arrival of a load from the approach side rail.

Thus, by one aspect of the invention there is provided a stub switch construction comprising:

(a) a pair of fixed longitudinally extending parallel, spaced straight through rails;

(b) a pair of fixed longitudinally extending parallel spaced turnout rails;

(c) a pair of longitudinally extending parallel spaced switch rails movable at one end thereof between a first position in axial alignment with said longitudinally extending straight through rails and a second position in axial alignment with said longitudinally extending turnout rails; and (d) a pair of radius arms extending, on opposed sides of each of said switch rails, from a selected attachment point thereon to a selected attachment point on opposed sides of said straight through and turnout rails respectively, to thereby transmit axial rail tension and compression forces through said switch.

By a preferred aspect of the invention there is further provided, in the stub switch described above, a prefabricated cast section welded thereto and to which respective ends of said radius arms are pivotally mounted, and tongue means projecting longitudinally from said cast section on each of said switch rails and complimentary slot means in each said cast section on each of said fixed rails, arranged to receive said tongue means as said switch rails move between said first and second positions, and thereby providing vertical register between said fixed and switch rails.

DESCRIPTION OF DRAWINGS

The invention will be described in more detail hereinafter with reference to the drawings in which.

DETAILED DESCRIPTION OF PREFERRED EMBODIMENTS

Figure 1:
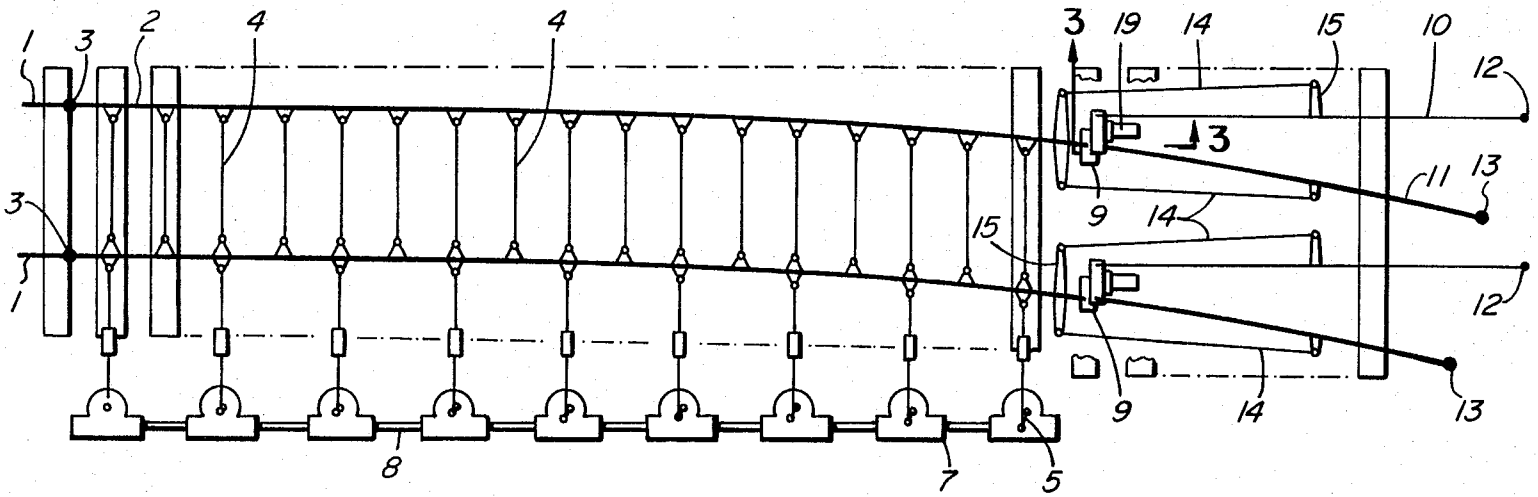
FIG. 1 is a plan view of a stub switch arrangement incorporating the present invention.

The plan view in FIG. 1 shows the stock rails (1) welded to the movable switch rails (2) at point of tangency (3). The movable switch rails (2) are approximately 55 feet (16.8 m) long. They are held to gauge by the gauge rods (4) which are pivotally connected to the switch rails.

Movement of the switch rails is controlled by a number of cranks (5), which are connected to the switch rails by connecting rods (6). The cranks (5) are operated by rotary hydraulic actuators (7). These actuators are mechanically connected in parallel by a synchronizing connecting rod (8).

The throw of cranks (5) is maximum at the points (9) of the switch rails. Succeeding cranks to the left have successively decreasing throws, until at the point of tangency, the throw is theoretically zero. All the cranks move through an arc of 190 degrees to set the switch to the turnout or the straight-away position and provide an over-centre locking device. The crank throws, therefore, define the horizontal alignment of the switch rail in either the straight-through profile or the turnout direction.

The straight-through fixed rails are designated (10), and the turnout fixed rails (11). These fixed rails are welded to the stock rails at (12) and (13) respectively. Axial rail tension or compression forces due to temperature fluctuation are transmitted through the switch points by means of the radius arm links (14). These links are connected to brackets (15) which project from cast sections in the switch rails and fixed rails, respectively. Beyond the brackets (15) on the frog side of the points, the track components and track geometry are identical with a standard #20 turnout.

The instantaneous centres of the radius arms (14) are some distance to the left of the point of the switch, so that the latter, in moving, approximate the arcs of circles with centres about 27 feet (8.2 m) to the left of the switch points. The function of the radius arms is to make expensive expansion joints at the switch unnecessary.

In the view of the hydraulic actuator assembly (FIG. 1), it is shown that the cranks are operated by pinions which mesh with racks. The racks are in turn connected to hydraulic pistons operating in cylinders. The switch is operated by pressurizing the hydraulic fluid in the cylinders and motion stops are effected by the pistons coming into contact with the internal surfaces of the cylinder end caps. The rack and pinion cavities are also full of oil, so that these critical moving parts and stops are protected from the elements by being immersed in oil.

It should be apparent from the above that the cranks have two extreme positions 190 degrees apart so that any lateral compressive force applied to the connecting rod, due to passage of a vehicle, will urge the piston into more forceful contact with the stop which already limits its motion. The converse is true for the other extreme position of the crank. The mechanism is therefore inherently self-locking in the sense that an external force cannot drive the system in reverse.

Figure 3:
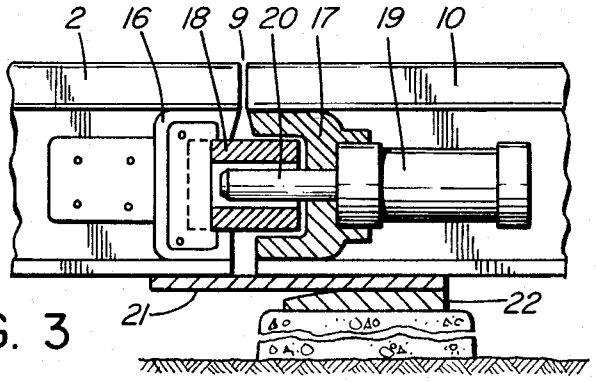
FIG. 3 is a side view of the interlocking arrangement between abutting ends of the switch rails.

At the points of the switch rails and the fixed rails, the butt ends of both sets of rails (2, 10 and 11) terminate with interlocking point shoes (16 and 17) as shown in FIG. 3. This interlocking is effected by tongues (18) which mate with slots in the shoes (17) in which they may slide laterally. These tongues provide vertical register between the switch rails and the stock rails. Lateral register in either the straight-through or the turnout switch rail positions is provided by hydraulic cylinders (19) which insert locking pins (20) into corresponding holes in the point shoes. In this way the switch rails are locked in register with the fixed rails in either position of the switch.

Figure 4:
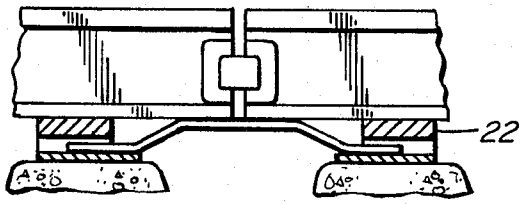
FIG. 4 is a side view of an alternative embodiment of the arrangement of FIG. 3.

At the point of the rails, the butt ends of the rails are supported on a flexible spring cushion cantilever (21) which is clamped by curved support plates (22). This provides a flexible cushion support at the points. An alternative point cushion design is shown in FIG. 4.

In operation the switch may be powered by a hydraulic power supply pack with electrically operated valve and signal logic. When setting the switch, this first operates the hydraulic cylinders (19) to withdraw the locking pins from the switch points. It then operates the hydraulic crank actuators (7) to set the switch rails in their new position prior to a second operation of the locking cylinders (19) to relock the system. If necessary, a secondary locking hydraulic cylinder can be installed in the rotary actuator synchronizing rod (8). Signalling is controlled by a system of light-emitting diode limit switches which will sense the integrity of the switch geometry, the register of the rail points, and the engagement of the locking rams before an all-clear signal is given. Failure of the system in any sense will generate a 'stop' signal.

Since the butt switch, by its very nature, provides a discontinuity in the rail, it is obvious that some means of supporting significant axial load in the stock rails must be provided if the switch is to be used in a continuously welded railway system subject to temperature variations. This could be done by providing an anchor at the point of tangency, a similar anchor on the frog side of the switch, and isolating the switch completely from the stock rails. Since the switch is a fairly long assembly, some means of compensating for expansion due to temperature changes should be provided, such as Conley joints. These are expansion joints and six per switch would be required. The cost of these is, however, very high.

Assuming that the operating temperature range is approximately 160° F. (89° C.), according to the AREA regulations manual, the rails should be laid between the mean temperature plus 15° F. (8° C.) and the mean temperature plus 25° F. (14° C.). Thus, the operating range for maximum rail stress is 80 plus 25°, that is 105° F. (58° C.). The stress associated with this temperature range is approximately 20,000 psi (138 MPa). Since the cross-sectional area of a 136 lb rail is 13.35 square inches (86 $cm^2$), the resulting axial load in the rail could be as high as 133.5 tons (1,188 kN) per rail. This means that the rail anchors provided on the stock rails have to be able to withstand such a longitudinal rail load.

Figure 2:
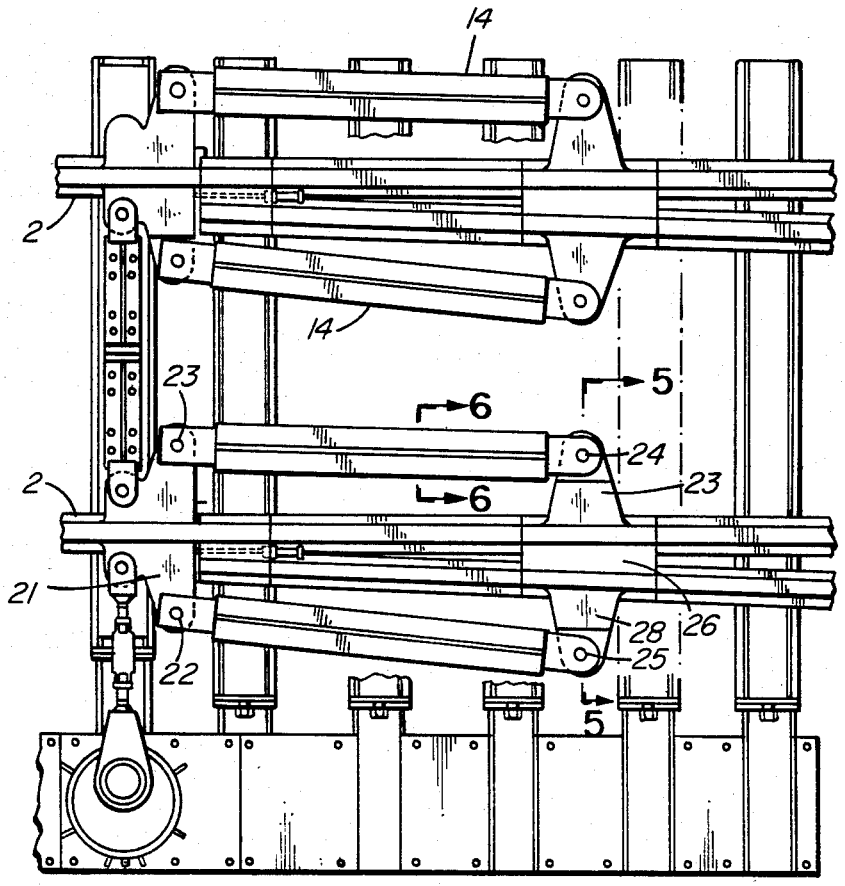
FIG. 2 is a plan view of the radius arm used in the arrangement of the stub switch.

In FIG. 2 it will be seen that the ends of the switch rails (2) at the butt are fitted with lateral steel plates (21) which carry two pivots (22, 23) on each rail. These pivots are connected to the radius arms (14) which in turn are pivoted to pins (24, 25) on the frog side of the point of the switch. These pins are supported in bearings which are in turn connected to prefabricated cast sections (26) having projecting ears (27, 28) and flash butt welded into the rails on the frog side of the point of the switch. This mechanism is capable of transmitting axial loads from the switch rails to the stock rails on the frog side. The switch rails may be welded to the stock rails at the point of tangency using the usual thermite welding process for in situ welding of continuous-welded rails. To provide continuity on the frog side of the point of the switch, straight-through and turnout fixed rails of the switch may in turn be welded to the stock rails in a similar manner. In this way, by means of the radius arm mechanism, the axial forces in the stock rails due to temperature differentials can be transmitted across the point of the switch. In addition, the radius arms ensure that the gap at the point of the switch will be maintained to a close tolerance. It is important to appreciate that the doubling of the temperature-induced longitudinal forces in the fixed rails due to the presence of the turnout rails, will mean that extra reaction forces will be transmitted to the rail anchors of the frog side of the switch. These must be made sufficiently strong to provide this reaction.

The centre-lines of the radius arms converge at points roughly half way between the point of the switch and the point of tangency. These points become the instantaneous centres of the mechanism which provides for movement of the switch points. The movement of the switch points, therefore, approximates to the arcs struck from centres roughly half way between the points of tangency and the points of the switch.

The action of the radius arms provides for another very useful feature. In moving the point of the switch, the radius arms actually provide moments at the point ends of the switch rails. If the action of all the rotary actuators excepting the last one nearest the point of the switch is ignored, then the action of the couple provided by the radius arms will tend to provide a constant bending moment down the length of the switch rails to the point of tangency. The switch rails thus act as cantilever beams built-in at the point of tangency and loaded with couples at the ends. The resulting constant longitudinal bending moment would induce the rail to take up the profile of the true arc of a circle. This profile is a requirement of specific designs of the switch, however the device is not limited to a specific profile. Any desired profile, i.e. a spiral can be provided.

Figure 5:
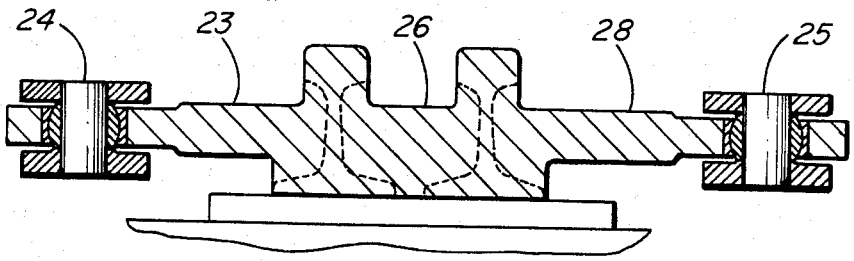
FIG. 5 is a section taken along the line 5—5 of FIG. 2.

Sections through the insert castings (26) are shown in FIG. 5. An additional feature of the rail insert casting (26), adjacent to the point of the switch is a vertical registering device which keeps the rails in vertical register and also a horizontal registering device. The horizontal register is provided by a hydraulic ram (19) which locks the castings together in either the straight-away position or the turnout position by means of a locking pin (20). The vertical register is provided by an interlocking tongue (18) which projects from the casting at the point of the switch rails and engages with a slot (17) in the casting on the frog side of the point of the switch. This may be seen in FIG. 3. Both registering systems are duplicated on each of the switch rails. It will be appreciated that as a train approaches the switch, approach rail (2) deflects somewhat and the tongue (18) signals that deflection to trailing side rail (10, 11) which also deflects somewhat, thereby reducing batter of the end of trailing side rail (10, 11).

Figure 6:
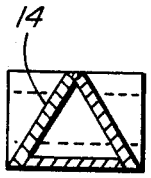
FIG. 6 is a section through the radius arm of FIG. 2.

The radius arms (14) which transmit the axial load in the rails across the switch are weldments which are triangular in section. A section through the radius arms (14) is shown in FIG. 6. The triangular section acts like a snowplow to break out any compacted snow or ice which may collect between the radius arms and the fixed rails of the switch. To provide vertical flexibility in the structure, the radius arm pins (22, 23, 24, 25) are fitted with spherical bearings which permit the pivots to move vertically without jamming.

I claim:

1. A stub switch construction comprising:

(a) a pair of fixed longitudinally extending parallel, spaced straight through rails;

(b) a pair of fixed longitudinally extending parallel spaced turnout rails;

(c) a pair of longitudinally extending parallel spaced switch rails movable at one end thereof between a first position in axial alignment with said longitudinally extending straight through rails and a second position in axial alignment with said longitudinally extending turn out rails; and (d) a pair of radius arms extending, on opposed sides of each of said switch rails, from a selected attachment point thereon to a selected attachment point on opposed sides of said straight through and turnout rails respectively, to thereby transmit axial rail tension and compression forces through said switch.

2. A stub switch as claimed in claim 1 wherein said radius arms are pivotally secured at each end thereof to respective ones of said fixed and switch rails.

3. A stub switch as claimed in claim 2 wherein each of said fixed and switch rails include a prefabricated cast section welded thereto and to which respective ends of said radius arms are pivotally mounted.

4. A stub switch as claimed in claim 1 wherein each said radius arm is triangular in cross-section to thereby deflect particulate or precipitate material deposited between each said radius arm and its respective fixed or switch rail.

5. A stub switch as claimed in claim 3 including tongue means projecting longitudinally from said cast section of each of said switch rails and complementary slot means in said cast section on each of said fixed rails, arranged to receive said tongue means as said switch rails move between said first and second positions, and thereby providing vertical register between said fixed and switch rails.

6. A stub switch as claimed in claim 5 including longitudinally extending locking pin means adjacent said fixed rails arranged to be received in a complementary slot means in said cast section in said switch rail, to thereby provide horizontal register between said fixed and switch rails.

7. A stub switch as claimed in claim 6 including hydraulic ram means operatively connected to said locking pin means for moving said pin means into and out of engagement with said complementary slot means.

* * * * *